US011781797B2

(12) United States Patent
Candeo et al.

(10) Patent No.: US 11,781,797 B2
(45) Date of Patent: Oct. 10, 2023

(54) REFRIGERATOR AIR DUCT

(71) Applicant: Electrolux Home Products, Inc., Charlotte, NC (US)

(72) Inventors: Marcelo Candeo, Anderson, SC (US); Cory Dale Simpson, Abbeville, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 70 days.

(21) Appl. No.: 16/916,639

(22) Filed: Jun. 30, 2020

(65) Prior Publication Data

US 2020/0386467 A1 Dec. 10, 2020

Related U.S. Application Data

(63) Continuation of application No. 13/203,414, filed as application No. PCT/US2010/025621 on Feb. 26, 2010, now abandoned.

(60) Provisional application No. 61/155,986, filed on Feb. 27, 2009.

(51) Int. Cl.

| | |
|---|---|
| ***F25D 17/04*** | (2006.01) |
| ***F25D 17/06*** | (2006.01) |
| *F25D 23/06* | (2006.01) |

(52) U.S. Cl.

CPC ..... *F25D 17/045* (2013.01); *F25D 17/065* (2013.01); *F25D 23/066* (2013.01); *F25D 2317/067* (2013.01); *F25D 2317/0666* (2013.01); *F25D 2321/1441* (2013.01)

(58) Field of Classification Search

CPC ... F24F 2011/0056; F24F 13/10; F25D 17/04; F25D 17/045; F25D 17/06; F25D 17/062; F25D 17/065; F25D 21/04; F25D 23/061; F25D 23/066; F25D 23/067; F25D 2321/1441; F25D 2317/063; F25D 2317/0666; F25D 2317/067

See application file for complete search history.

(56) References Cited

U.S. PATENT DOCUMENTS

| | | | |
|---|---|---|---|
| 2,962,872 | A | 12/1960 | Crotser et al. |
| 3,169,383 | A | 2/1965 | Morton et al. |
| 3,280,583 | A | 10/1966 | Jones et al. |
| 3,548,871 | A | 12/1970 | O'Grady |
| 4,557,118 | A | 12/1985 | Pink et al. |

(Continued)

FOREIGN PATENT DOCUMENTS

WO 20080120927 10/2008

OTHER PUBLICATIONS

International Search Report for PCT/US2010/025621, dated Dec. 9, 2010, 3 pages.

(Continued)

*Primary Examiner* — Len Tran
*Assistant Examiner* — Hans R Weiland
(74) *Attorney, Agent, or Firm* — Pearne & Gordon LLP

(57) ABSTRACT

Provided is a refrigeration appliance that includes a fresh food compartment and a freezer compartment. An opening is provided between the freezer compartment and the fresh food compartment to allow air to flow from the fresh food compartment to the freezer compartment and an air tower located within the fresh food compartment is adapted to deliver air from the freezer compartment to the fresh food compartment.

7 Claims, 7 Drawing Sheets

(56) References Cited

U.S. PATENT DOCUMENTS

| | | | | |
|---|---|---|---|---|
| 4,642,998 | A | 2/1987 | Kang et al. | |
| 5,214,936 | A | 6/1993 | Lim et al. | |
| 5,369,963 | A | 12/1994 | Pickles et al. | |
| 5,546,759 | A | 8/1996 | Lee | |
| 5,718,123 | A * | 2/1998 | Park | F25D 17/045 62/407 |
| 5,778,694 | A | 7/1998 | Jeong | |
| 5,893,620 | A | 4/1999 | Birgellis | |
| 6,044,654 | A | 4/2000 | Igari et al. | |
| 6,125,641 | A * | 10/2000 | Kim | F25D 17/045 62/187 |
| 6,238,032 | B1 | 5/2001 | Cooper et al. | |
| 6,347,530 | B1 | 2/2002 | Kim | |
| 6,401,482 | B1 | 6/2002 | Lee et al. | |
| 6,604,377 | B2 | 8/2003 | Watanabe et al. | |
| 6,647,740 | B2 | 11/2003 | Noritake | |
| 7,299,651 | B2 | 11/2007 | Oh | |
| 2005/0076670 | A1* | 4/2005 | Noritake | F25D 17/045 62/408 |
| 2005/0126206 | A1* | 6/2005 | Oh | F25D 17/062 62/407 |
| 2006/0168989 | A1 | 8/2006 | Park | |
| 2007/0012055 | A1* | 1/2007 | Schenk | F25B 49/025 62/208 |
| 2007/0028643 | A1 | 2/2007 | Revlett et al. | |
| 2007/0266727 | A1 | 11/2007 | Bae et al. | |
| 2008/0256964 | A1* | 10/2008 | Lee | F25D 17/045 62/187 |

OTHER PUBLICATIONS

User Manual for LG Fridge Freezer GR409GQA, 8 pages.
User Guide LG French Door LFX25971SW, 43 pages.
Print shot from LG website: LG GR409GQA, 1 page.
Print shot from LG website: LFX25971SW, 2 pages, www.lg.com/us/support-product/lg-LFX25972SW.
Opposition dated Jul. 5, 2017 for EP2401563, including Annex 1, 16 pages.

* cited by examiner

REFRIGERATOR AIR DUCT

CROSS-REFERENCE TO RELATED APPLICATIONS

This application is a continuation of Ser. No. 13/203,414 filed on Nov. 7, 2011, which is a 371 of PCT/US2010/025621 filed Feb. 26, 2010, which claims the benefit of U.S. Provisional Application No. 61/155,986, filed Feb. 27, 2009, which is incorporated in its entirety herein by reference.

FIELD OF THE INVENTION

The present invention relates generally to refrigerators, and more particularly to an air tower mounted to a liner in the fresh food compartment of a refrigerator.

BACKGROUND OF THE INVENTION

Refrigerator liners and air towers are known and used in many different applications. The fresh food compartment of a refrigerator may include a liner with an air distribution means mounted to the liner. Conventional air ducts for transporting cold air from the freezer compartment to the fresh food compartment include an air duct formed in the foam insulation between the fresh food compartment and the freezer compartment. Pre-foam support members must be installed to support shelves and drawers within the fresh food compartment. Thus, there is a continuing need for an air duct that may be installed after foaming has occurred. Furthermore, when the fresh food compartment is filled with perishable items by a user, the flow of cool air into the fresh food compartment can be obstructed. This may occur because cool air falls to the bottom of the fresh food compartment, making it difficult to circulate the cool air near the top. Therefore, there is a continuing need for an air duct that promotes cool air circulation within the fresh food compartment even when filled with perishable items.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a refrigeration appliance is shown comprising a freezer compartment maintaining air at a temperature of zero degrees Centigrade or less and a fresh food compartment maintaining air at a temperature greater than zero degrees Centigrade, an opening between the freezer compartment and fresh food compartment, the opening configured to allow air to flow from the fresh food compartment to the freezer compartment, an air tower adapted to be located within the fresh food compartment, the air tower configured to be in fluid communication with the fresh food compartment and freezer compartment, and a damper door adapted to be secured within the air tower and configured to pivot between a closed position and an open position, wherein the closed position of the damper door partially restricts flow through the air tower. In addition, air is adapted to flow from the freezer compartment through the air tower and into the fresh food compartment before flowing through the opening from the fresh food compartment to the freezer compartment In accordance with another aspect of the present invention, a refrigeration appliance is shown comprising a freezer compartment maintaining air at a temperature of zero degrees Centigrade or less and a fresh food compartment maintaining air at a temperature greater than zero degrees Centigrade, an opening between the freezer compartment and fresh food compartment, the opening configured to allow air to flow from the fresh food compartment to the freezer compartment, an air tower adapted to be located within the fresh food compartment, the air tower configured to be in fluid communication with the fresh food compartment and freezer compartment, wherein the air tower includes a connection means for removably attaching the air tower to a wall of the fresh food compartment, and a damper door adapted to be secured within the air tower and configured to pivot between a closed position and an open position, wherein the closed position of the damper partially restricts flow through the air tower. In addition, air is adapted to flow from the freezer compartment through the air tower and into the fresh food compartment before flowing through the opening from the fresh food compartment to the freezer compartment.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
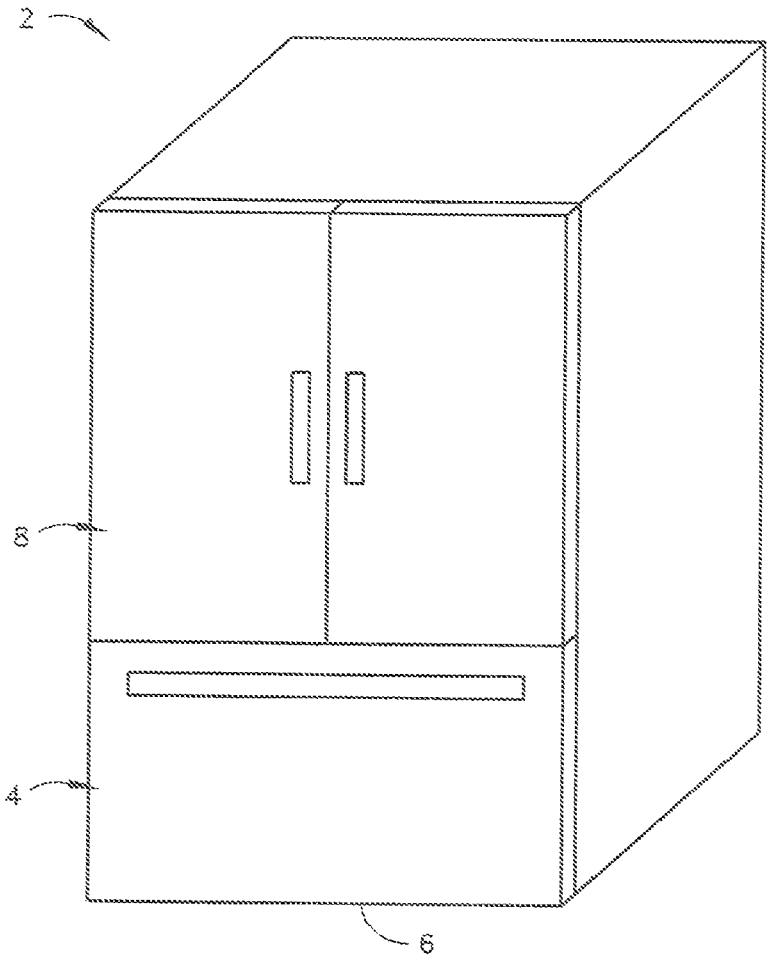
FIG. 1 illustrates a perspective view of an example refrigerator.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to the shown example of FIG. 1, the present invention relates generally to a refrigerator 2 including a freezer compartment 4 located in the lower portion of the refrigeration appliance. The freezer compartment 4 may be accessed through a bottom mounted pull-out freezer door 6. The freezer compartment 4 is used to freeze and/or maintain food articles stored within in a frozen condition. The freezer compartment 4 may be maintained at an air temperature at or below zero degrees Centigrade. The upper portion of the refrigerator 2 includes a fresh food compartment 8. The fresh food compartment 8 may be used to keep food articles fresh and maintain an air temperature near and above zero degrees Centigrade.

Figure 2:
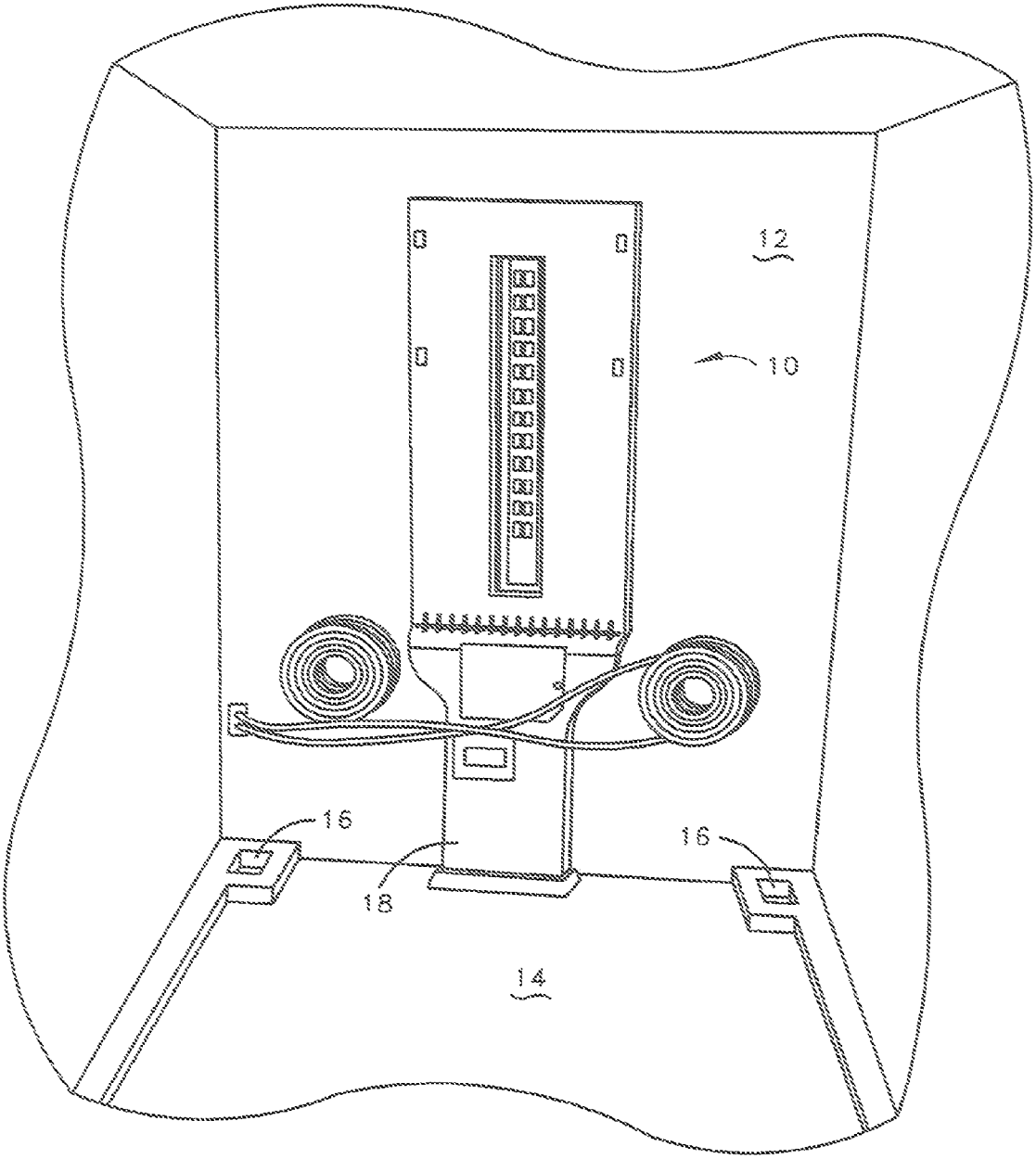
FIG. 2 illustrates a front view of an example air tower mounted in a fresh food compartment of a refrigerator.

Turning to the shown example of FIG. 2, there is shown the interior of the fresh food compartment of the refrigerator 2. The interior includes an air tower 10 secured to the back of the fresh food compartment 8 to the rear wall of a liner 12. The interior is shown with tubing comprising a water tank. This tubing may be concealed by a mounting structure, such as a shelf, drawer, etc. and may be used to provide water to a water dispenser, ice dispenser, etc. The bottom of the fresh food compartment comprises a floor 14. The floor 14 may also include inlet openings 16. The inlet openings 16 may serve as air ducts that direct air from the fresh food compartment to the freezer compartment below. Air that has circulated through the fresh food compartment may return to the freezer through the inlet openings 16. The floor 14 may also include an exhaust opening 18. The exhaust opening 18 serves as an air duct in the floor through which cold air from the freezer compartment is directed to the fresh food compartment.

The floor 14 of the fresh food compartment may be recessed in the center. Liquid spills from the fresh food compartment may occur, originating from spillage of items, condensation buildup, etc. and may lead to liquid buildup. The floor 14 is recessed to accommodate for this liquid buildup. In one embodiment, the floor 14 may be recessed only in the center with raised margins at the sides, the front, and the rear wall of the fresh food compartment floor. Furthermore, the recessed portion of the floor 14 may be lower than the inlet openings 16 and the exhaust opening 18. The recess 14 serves to confine any liquid that is on the floor and may be designed to have varying volumetric capacities, such as holding one gallon of liquid. Having the center of the floor 14 recessed minimizes the likelihood that any of the liquid would spill over and enter either of the openings 16, 18. Similarly, the recessed center of the floor 14 reduces the chances of pooled liquid dripping from the front of the refrigerator compartment.

Figure 3:
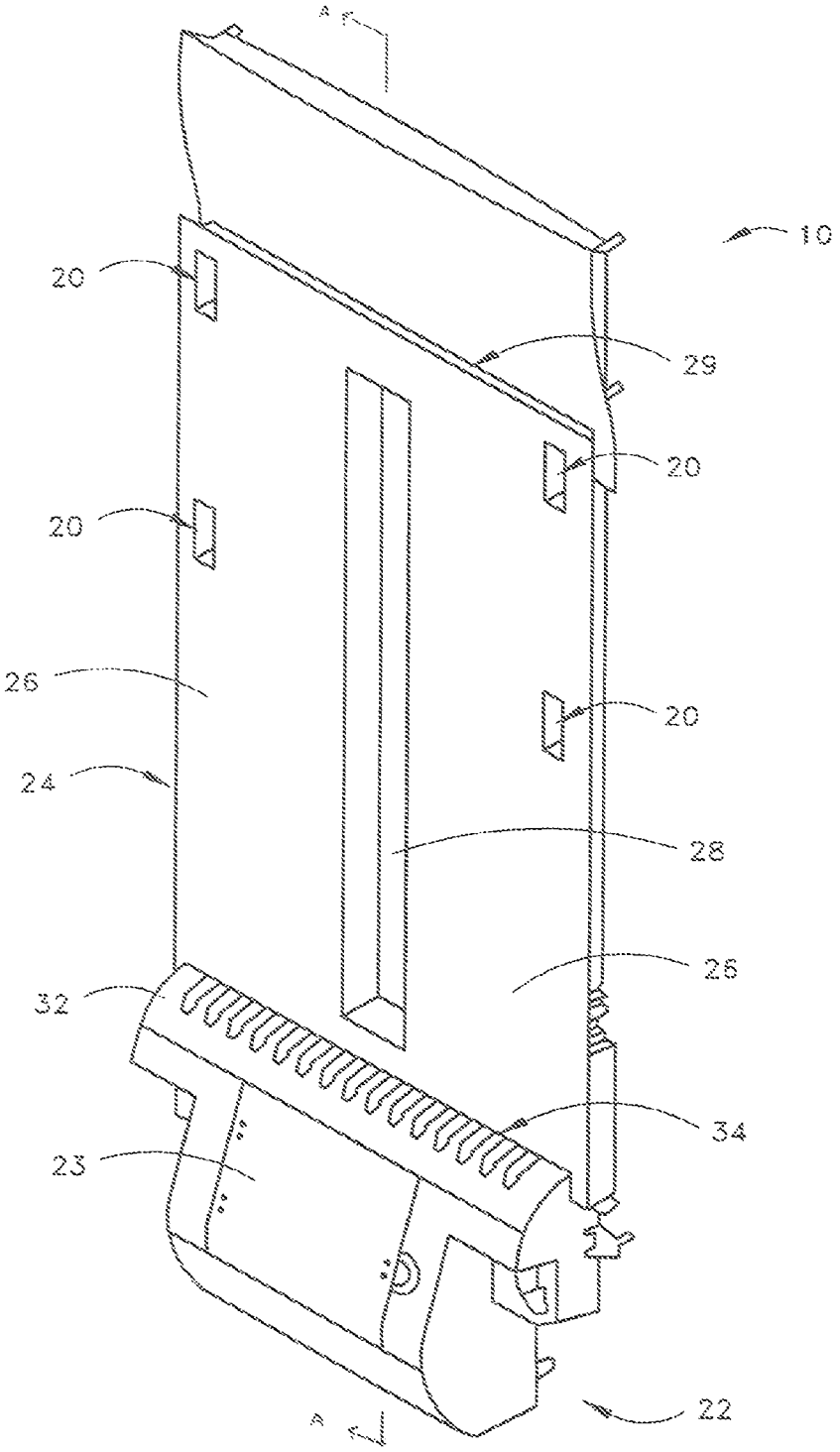
FIG. 3 illustrates a perspective view of the example air tower.

Turning to the shown example of FIG. 3, there is shown the air tower 10. The air tower 10 can be secured to the liner 12 by an attachment means, which may include fasteners, screws, etc. which will be discussed later with reference to FIG. 7. The air tower 10 is open at the back and mounted to the rear wall of the liner 12 such that the rear wall closes off the back of the air tower 10 so as to form a duct through which air may pass. Consequently, air passing through the air tower 10 will be bounded at the back by the rear wall of the liner 12 and bounded at the front by the air tower 10. The air tower 10 includes an upper portion 24 that may be divided into two separated air passageways 26. Each air passageway 26 is in air flow communication with a lower portion 22 of the air tower 10. An access door 23 may be formed in the lower portion 22 of the air tower 10. The air tower 10 may also include an open space 28 that lies between the separated passageways 26. A mounting structure, such as a bracket, ladder etc. (not shown) may be inserted and secured to the open space 28. The liner 12 may include holes to support a mounting structure, such as a shelf, drawer, etc. that is mounted centrally to the real wall of the liner 12. Thus, the air tower 10 will not interfere with the installation of shelves within the fresh food compartment.

The upper portion 24 of the air tower 10 may be provided with openings 20. These openings 20 allow cool air from the freezer compartment to pass upwardly through the air tower 10 and to be discharged through from the air passageways 26 to the openings 20 and into the interior of the fresh food compartment 8. The openings 20 may be formed on each air passageway 26. While there are two openings shown on each air passageway 26, it is to be understood that there may be any number of openings in various shapes and sizes. An aperture 29 may be formed at the top of the upper portion 24.

Figure 5:
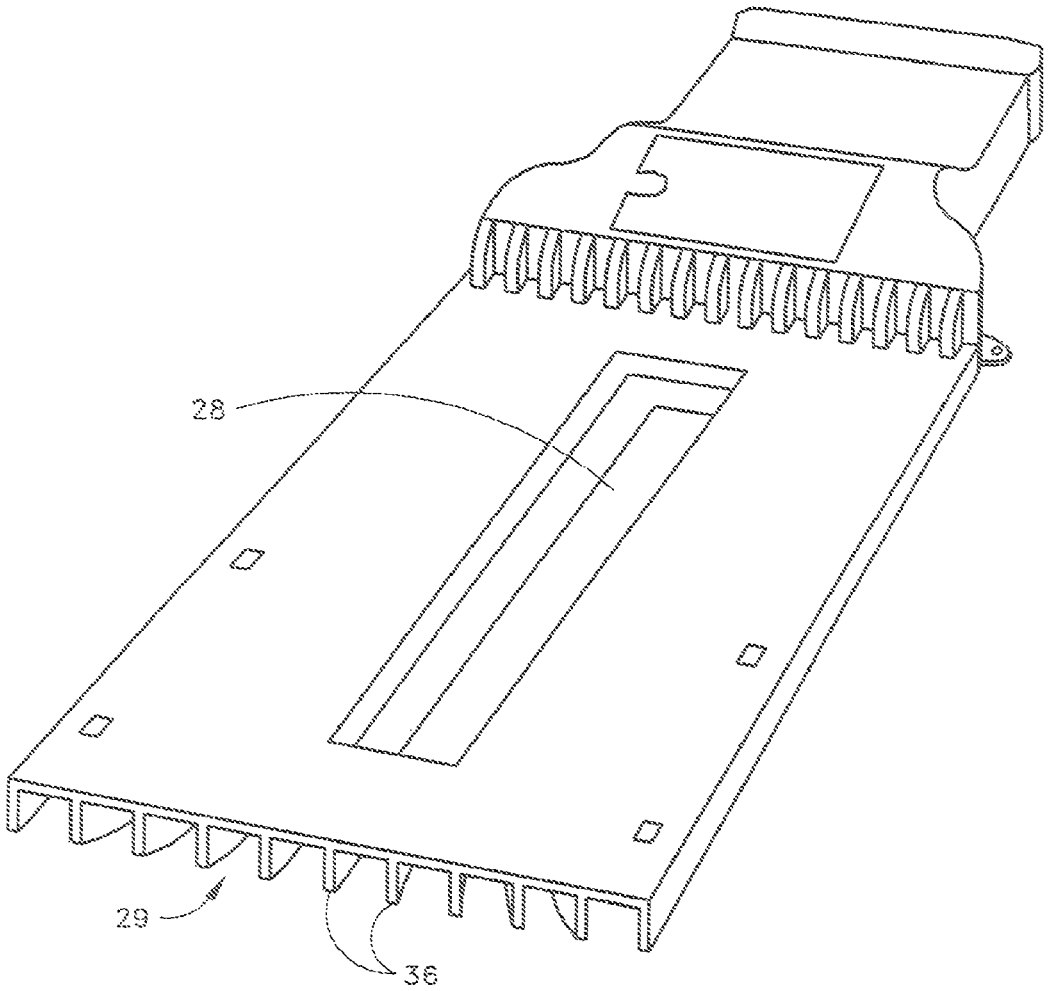
FIG. 5 illustrates a top view of the example air tower.

Referring to the shown example of FIG. 5, a plurality of air-directing fins 36 may be included at the top of the air tower 10 to direct air that passes over the openings 20 but does not leave the openings 20. As mentioned, the air tower and rear wall of the liner 12 form a duct through which air can pass. The air-directing fins 36 are formed at the top of the air tower 10 near the aperture 29. Air may pass through the air passageways 26, and be directed towards the aperture 29 at the top of the fresh food compartment 8. The fins 36 may be angled so as to direct and distribute air across the top of the fresh food compartment as it exits the aperture 29. The air-directing fins 36 may be included to direct air laterally across the top of the fresh food compartment 8 and ensure that air is substantially spread across the fresh food compartment. It is to be understood, however, that the size and quantity of air-directing fins 36 is variable, however, and may include more or less fins than shown in the example.

Figure 4:
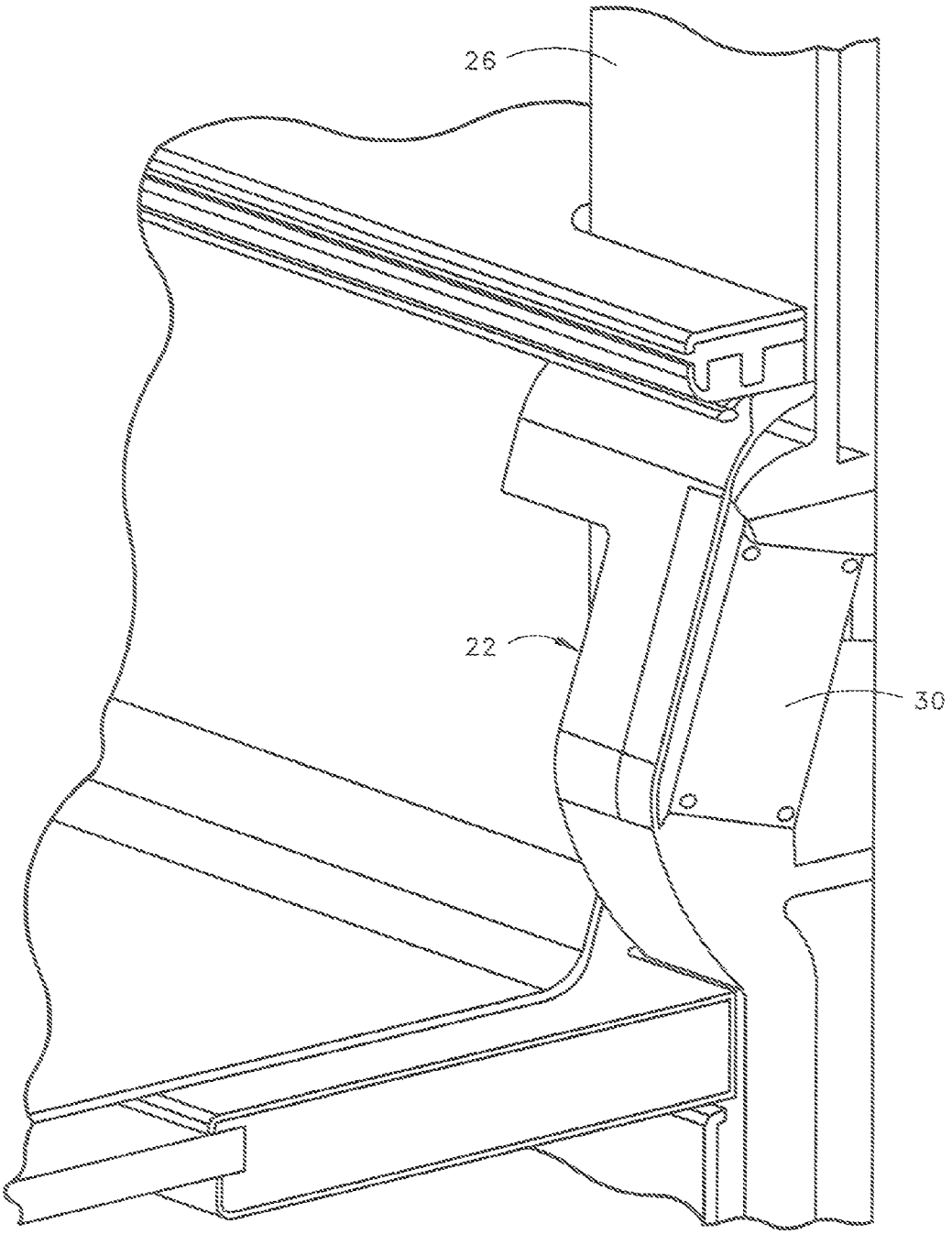
FIG. 4 illustrates a cross-sectional view of a lower portion of the example air tower taken along line A-A of FIG. 2.

Referring back to FIG. 3, the air tower 10 may further include a support ledge 32 having a plurality of ribs 34. The support ledge 32 may be formed at the intersection of the upper portion 24 and lower portion 22 of the air tower 10. The ribs 34 of the support ledge 32 act to create a supporting surface for the rear portion of a mounting structure, such as a drawer, shelf, etc. (not shown). By having ribs 34, air that circulates through the fresh food compartment may pass through the ribs behind the mounting structure. Thus, the mounting structure will not block the flow of air through the fresh food compartment. The lower portion 22 of the air tower is shown more clearly in FIG. 4. The lower portion 22 may include one or more dampers 30 that may control the flow of air through the lower portion 22.

Figure 6:
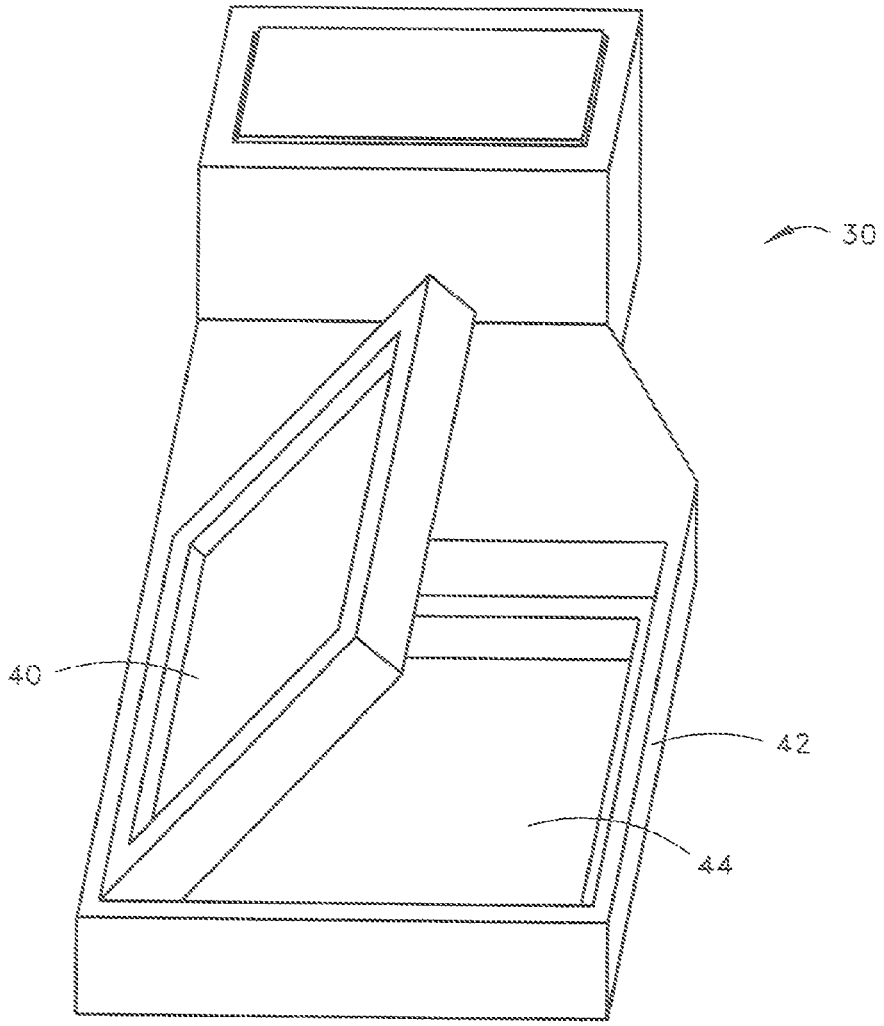
FIG. 6 illustrates a perspective view of an example damper.

Turning to the shown example of FIG. 6, there is shown the damper 30. The damper 30 may be positioned within the lower portion 22 of the air tower 10 and is designed to control the flow of air between the freezer compartment 4 and fresh food compartment 8. The damper 30 may be attached in the air duct between such that it is bounded in the rear by the liner 12 and in the front by the air tower 10. The damper may be accessed by removing the access door 23 in the lower portion 22 of the air tower 10. Similarly, a stepper motor (not shown) may also be accessed by removing the access door 23.

The damper 30 may include a damper door 40, damper door frame 42, and an opening 44 through which air may pass. When the damper door 40 is open (e.g. a second non-zero angle), moisture from the fresh food compartment may accumulate on the damper door frame 42. If the damper door 40 is then closed all the way to a horizontal orientation, the damper door 40 may rest on the moisture soaked damper door frame 42 and freeze shut. To reduce the risk of freezing, the damper door 40 may form an angle (e.g. a first non-zero angle) from the conventional fully horizontal closed position. The angle of the fully closed position may be, for instance, 9°. The open/closed position of the damper door 40 may be controlled by a stepper motor (not shown). Therefore, the fresh food and freezer compartments may be in fluid communication even when the damper door 40 is in its fully closed position. In this embodiment, the damper door 40 may not contact the frame 42 when in a fully closed position. The stepper motor may be prompted by a user, electronic control, etc. to open and close, thus allowing more or less cold air from the freezer to pass through. For instance, if a sensor detects that the temperature in the fresh food compartment is too high, it may prompt a control to open the damper door 40 by the stepper motor.

Figure 7:
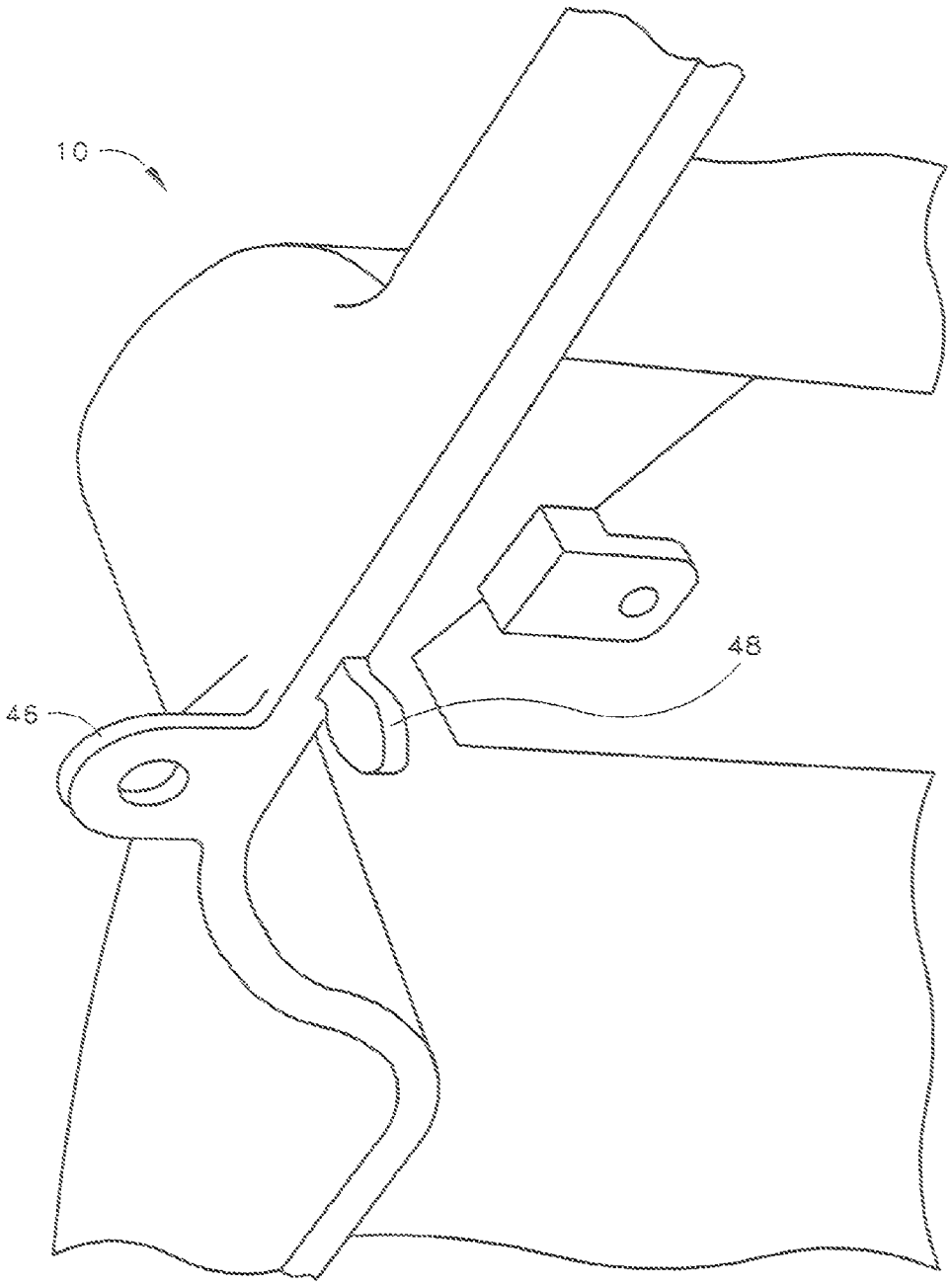
FIG. 7 illustrates a rear view of an example mounting means of the air tower.

Turning to the shown example of FIG. 7, there is shown a view of the connection means to secure the air tower 10 to the rear wall of the fresh food compartment liner 12. The liner 12 may include threaded holes to receive threaded fasteners, such as screws or the like. The liner 12 may also include apertures for the insertion of snap fasteners. The air tower 10 includes a flange 46 and snap fasteners 48. The flange 46 has a hole in it to receive the screws that will attach the tower 10 to the liner 12. In addition, the air tower 10 may have one or more snap fasteners 48 extending from a side of the air tower adjacent to the flange 46. To secure the air tower 10 to the liner 12, the snap fasteners 48 are inserted into open holes within the liner 12 such that the tower 10 does not have to be manually held in place. Once the snap fasteners 48 are secured to the liner, the flange 46 may be aligned such that the hole in the flange 46 is positioned next to the threaded hole in the liner 12. A screw may then be inserted into the hole of the flange 46 and screwed into the threaded hole in the liner 12, thus securing the air tower 10 in place.

The air tower 10 functions by allowing cool air from the freezer compartment 4 to pass to the fresh food compartment 8. Cool air from the freezer compartment 4 enters the air tower 10 in the freezer and passes through the damper 30. An air moving device, evaporator fan, or the like (not shown) may also be provided for providing an upward pressure to the cool air. After passing through the damper 30, the cool air, under the impetus of the air moving device, passes upwardly through the two separated passageways 26. Some of the upwardly-moving cool air may be discharged to the interior of the fresh food compartment 8 through the openings 20. The remaining cool air that does not pass through the openings 20 is directed by fins 36 and discharged through the aperture 29 at the top of the air tower 10. The discharged air leaves the aperture 29 and enters the upper portion of the interior of the fresh food compartment. The discharged air then descends into the interior of the fresh food compartment and cools food items located there. This arrangement ensures that items throughout the fresh food compartment, including those at the upper portion of the fresh food compartment are adequately cooled. As the discharged air descends further, it may return to the freezer compartment by passing through the inlet openings 16 at the bottom of the fresh food compartment.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A method for controlling a refrigeration appliance comprising a freezer compartment and a fresh food compartment, the method comprising:

conveying air from the freezer compartment to the fresh food compartment through an air tower, the air tower located within the fresh food compartment; and moving a door of a damper disposed in the air tower between a closed position and an open position based on a temperature of the fresh food compartment, the damper including a frame defining an opening through which a flow of air passes from the freezer compartment to the fresh food compartment, the door having a proximal end and a distal end, the proximal end pivotable with respect to the opening about an axis parallel to a side the frame, wherein the door is configured to contact the frame when in a fully closed position that is different from the closed position, wherein the closed position of the door is defined by the door being at a first non-zero angle relative to the frame and wherein movement of the door between the open position and the closed position does not include the distal end of the door contacting the frame of the damper before stopping at the closed position.

2. The method of claim 1, wherein the step of conveying air includes conveying air in an upward direction through two separated air passageways disposed between a liner of the fresh food compartment and the air tower.

3. The method of claim 2, wherein at least one of the two separated air passageways includes at least one passageway opening for exhausting air into the fresh food compartment.

4. The method of claim 1, wherein the step of moving a door of a damper includes moving the door between the first non-zero angle and a second non-zero angle corresponding to the open position, wherein the first non-zero angle is a smallest angle between the door and the frame and the second non-zero angle is a largest angle between the door and the frame.

5. The method of claim 4, wherein the first non-zero angle is 9 degrees.

6. The method of claim 1, wherein the step of moving a door of a damper includes allowing a minimum, non-zero amount of air to flow through the opening when the door is in the closed position and a maximum amount of air to flow through the opening when the door is in the open position.

7. The method of claim 1, wherein the step of moving a door of a damper always permits the air to flow through the opening of the frame.

* * * * *